US011619459B2

(12) United States Patent
Lynch

(10) Patent No.: US 11,619,459 B2
(45) Date of Patent: Apr. 4, 2023

(54) ADJUSTABLE GAS BLOCK

(71) Applicant: Game Scout, LLC, Milan, TN (US)

(72) Inventor: Kyle Lynch, Milan, TN (US)

( * ) Notice: Subject to any disclaimer, the term of this patent is extended or adjusted under 35 U.S.C. 154(b) by 37 days.

(21) Appl. No.: 17/372,729

(22) Filed: Jul. 12, 2021

(65) Prior Publication Data

US 2022/0049913 A1 Feb. 17, 2022

Related U.S. Application Data

(63) Continuation-in-part of application No. 16/904,883, filed on Jun. 18, 2020, now Pat. No. 11,060,807, which is a continuation-in-part of application No. 16/214,693, filed on Dec. 10, 2018, now Pat. No. 10,724,812.

(60) Provisional application No. 62/617,759, filed on Jan. 16, 2018.

(51) Int. Cl.
*F41A 5/28* (2006.01)

(52) U.S. Cl.
CPC ..... *F41A 5/28* (2013.01)

(58) Field of Classification Search
CPC ..... F41A 5/28
USPC ..... 89/193
See application file for complete search history.

(56) References Cited

U.S. PATENT DOCUMENTS 8,161,864 B1 * 4/2012 Vuksanovich ..... F41A 5/26 89/193
8,468,929 B2 * 6/2013 Larson ..... F41A 35/06 89/193
8,667,883 B1 * 3/2014 Larson ..... F41C 23/04 89/193
8,813,632 B2 * 8/2014 Adams ..... F41A 5/28 89/193
9,410,756 B2 * 8/2016 Gardner ..... F41A 5/28
10,101,104 B2 * 10/2018 Zheng ..... F41A 5/28
10,557,675 B1 * 2/2020 Robinson ..... F41A 5/24
2010/0186582 A1 * 7/2010 Juarez ..... F41A 5/28 89/191.01
2010/0269682 A1 * 10/2010 Vuksanovich ..... F41A 5/28 89/191.01
2011/0271827 A1 * 11/2011 Larson ..... F41A 5/28 89/193
2014/0060312 A1 * 3/2014 Ruck ..... F41A 5/28 89/193
2014/0076149 A1 * 3/2014 Adams ..... F41A 5/28 89/192
2014/0190344 A1 * 7/2014 Kenney ..... F41A 5/28 89/193
2015/0253091 A1 * 9/2015 Gardner ..... F41A 5/20 89/193
2016/0047614 A1 * 2/2016 Larson, Jr. ..... F41G 11/003 89/191.01

(Continued)

*Primary Examiner* — Samir Abdosh
(74) *Attorney, Agent, or Firm* — Braxton Perrone, PLLC; Bobby W. Braxton; Gregory Perrone

(57) ABSTRACT

A system for an adjustable gas block. The gas block body has a main chamber fluidly coupled to a gas aperture which is fluidly connected to a plunger channel and a gas return path. Downstream of the gas block body is a plunger assembly which includes a ring and a plunger. Further downstream is an adjustment knob which is coupled to the gas block body and which is adjustable upstream and downstream relative to the gas block body. The volume of plunger inserted into the channel path is controlled by the adjustment knob.

12 Claims, 8 Drawing Sheets

(56) References Cited

U.S. PATENT DOCUMENTS

| | | | | |
|---|---|---|---|---|
| 2018/0180370 | A1* | 6/2018 | Zheng | F41A 5/28 |
| 2020/0033085 | A1* | 1/2020 | Robinson | F41A 5/28 |

* cited by examiner

ADJUSTABLE GAS BLOCK

PRIORITY

The present invention is a continuation-in-part of U.S. application Ser. No. 16/904,883 filed Jun. 18, 2020, which is a continuation-in-part of U.S. application Ser. No. 16/214,693 filed Dec. 10, 2018, now U.S. Pat. No. 10,724,812 issued Jul. 28, 2020, which claims priority to U.S. Provisional Application No. 62/617,759 filed Jan. 16, 2018, the entirety of both of which are hereby incorporated by reference.

BACKGROUND OF THE INVENTION

Technical Field

The present invention relates to a system for an adjustable gas block.

Description of Related Art

Self-loading gas-operated firearms require an operating system with three balanced component areas. These include, reciprocating mass, spring performance (rate and resistance), and gas (pressure, volume, and timing). Upon firing, the gasses developing from the combustion of gunpowder within the cartridge expand rapidly, pushing the bullet down the bore of the barrel towards the muzzle of the barrel where the bullet is released into flight and the gas pressure subsides. Some of that gas is bled off to be used in the self-loading operation. A portion of the gas is directed to a gas block which directs the gas to a gas tube or other gas path. The gas tube uses the gas for the self-loading operation. While some gas blocks are adjustable, the adjustments are typically limited and often require separate tools to perform the adjustment. Consequently, there is a need for an adjustable gas block.

BRIEF DESCRIPTION OF THE DRAWINGS

The novel features believed characteristic of the invention are set forth in the appended claims. The invention itself, however, as well as a preferred mode of use, further objectives and advantages thereof, will be best understood by reference to the following detailed description of illustrative embodiments when read in conjunction with the accompanying drawings, wherein:

DETAILED DESCRIPTION

Several embodiments of Applicant's invention will now be described with reference to the drawings. Unless otherwise noted, like elements will be identified by identical numbers throughout all figures. The invention illustratively disclosed herein suitably may be practiced in the absence of any element which is not specifically disclosed herein.

Figure 1:
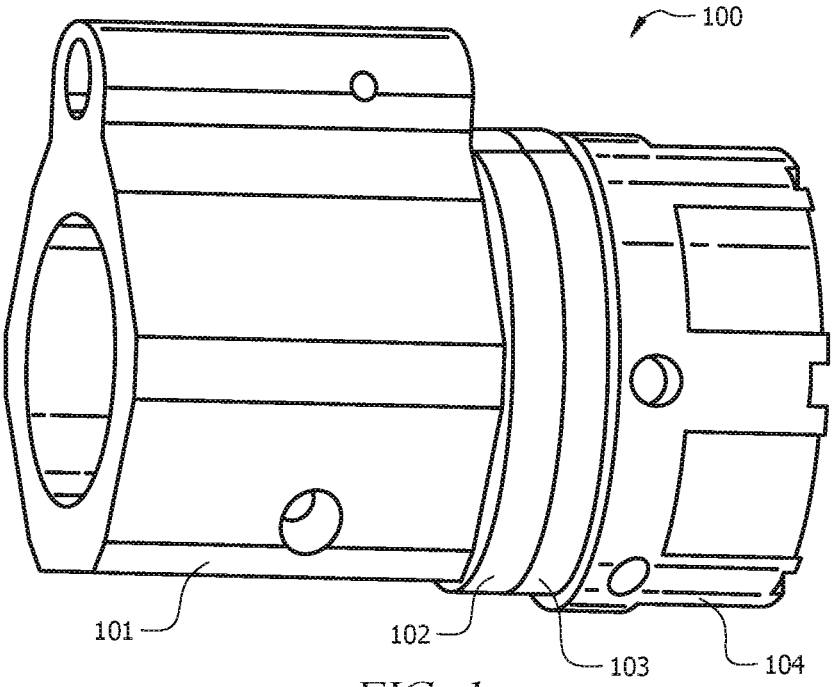
FIG. 1 is a perspective view of a gas block in one embodiment.

FIG. 1 is a perspective view of a gas block in one embodiment. Positioned along the barrel is a gas port which bleeds off part of the expanding gasses through an attached gas block, such as one depicted in FIG. 1. Thereafter, these gases are directed to an attached gas tube. The gasses are then used to operate the firearm. Beginning with the presentation of gas to the action (or piston in some cases), this operation includes: unlocking, extracting, ejecting, cocking, feeding, chambering, and locking. The pressure, volume, and timing (duration) of the gasses presented to the action of the weapon affect all of these functions. At this point, the shooter may or may not fire again.

Figure 2:
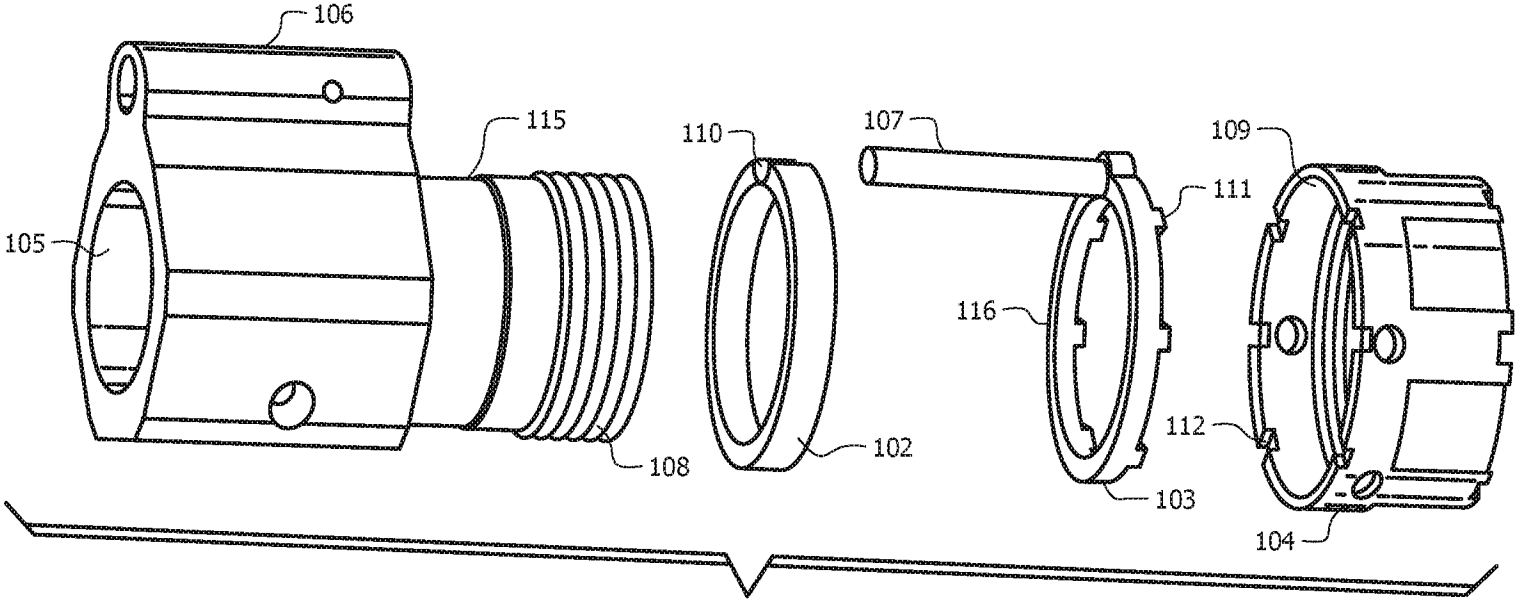
FIG. 2 is a side perspective exploded view of a gas block in one embodiment.
Figure 3:
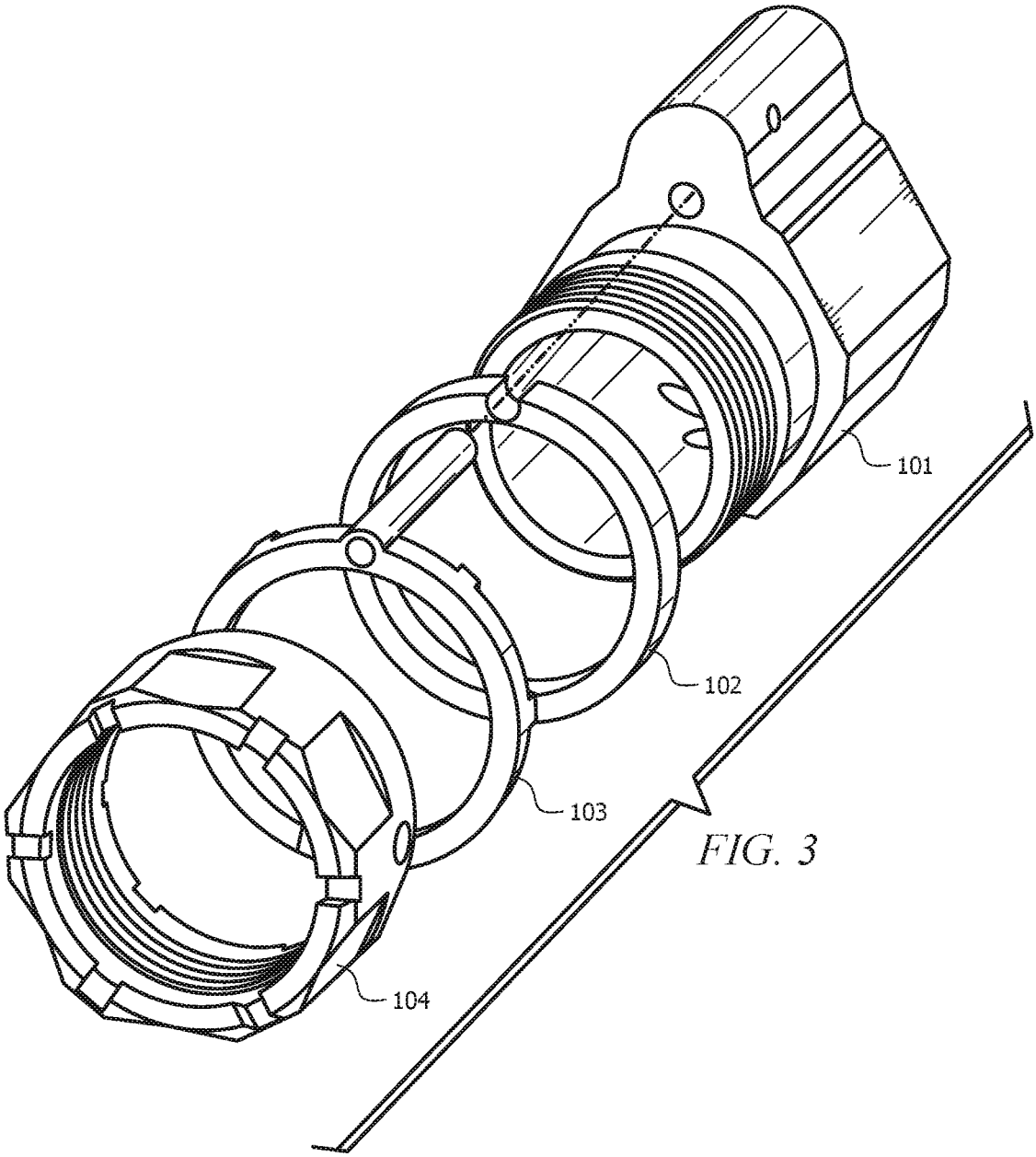
FIG. 3 is a front perspective exploded view of a gas block in one embodiment.

The gas block 100 will be described in reference to FIGS. 1-4. FIG. 2 is a side perspective exploded view of a gas block 100 in one embodiment, and FIG. 3 is a front perspective exploded view of a gas block 100 in one embodiment. The gas block 100 can comprise virtually any shape or dimension to fit a particular firearm. The gas block 100 can be used in virtually any self-loading firearm and can include rifles, shotguns, pistols, etc. The gas block 100 can comprise any suitable material including metal, plastic, and combinations thereof. In one embodiment the gas block 100 is positioned outside of a barrel. Thus, in such embodiments the gas block 100 surrounds the outer diameter of a barrel. In still other embodiments, however, the gas block 100 is part of and attached to the barrel.

The gas block 100, in one embodiment, comprises five components: the gas block body 101, the wavy spring 102, the plunger ring 103, the plunger 107, and the adjustment knob 104. The coupling of these components is discussed below. In one embodiment these five components are assembled without the need for any external parts such as screws, bolts, springs, etc. Additionally, in one embodiment, and discussed in more detail below, the components can be adjusted with no tools. Further, in one embodiment, the components can be assembled and disassembled with no tools.

Beginning with the gas block body 101, the gas block body 101 comprises an internal main chamber 105, an internal gas return path 106, an elongated coupling member 115, and a coupling device 108. The main chamber 105 is the chamber which is in line with the firearm barrel. As noted, in one embodiment the barrel is inserted through the gas block. The bullet and most of the gas pass within the barrel from left to right as depicted in FIG. 2. The barrel extends through the main chamber 105 of the gas block body 101, the wavy spring 102, the plunger ring 103, and through the center of the adjustment knob 104. It should be noted that while in one embodiment the adjustment mechanism is located circumferentially around the barrel, this is for illustrative purposes only and should not be deemed limiting. In one embodiment there is a spring which surrounds the plunger 107 but does not surround the barrel. In some of these embodiments the design does not require a coupling ring. Further, the design does not include an adjustment knob which is circumferentially located around the barrel. In one embodiment the plunger comprises a spring-loaded plunger. The spring compresses between the plunger channel and the flange on the plunger. It operates similar to a click-button ball-point pen where the spring surrounds the button mechanism within the pen body.

The gas block body 101 also comprises a gas return path 106. The gas return path 106 is the path which returns gases back to the firearm to assist in the self-loading abilities. The gas return path 106 is fluidly coupled to the main chamber 105 such that gas traveling through the main chamber 105 can also flow through the gas return path 106. The relative size of each chamber or path will be determined by the size and caliber of the firearm. In one embodiment the gas return path 106, the gas aperture 113 and/or the plunger channel 114 (both shown in FIG. 4) are voids or cavities formed with the body of the gas block body 101. These voids can be formed via any method known in the art including etching, machining, carving, and molding. The diameters for each of these components can vary. In one embodiment the common diameters for the main chamber range from 0.625" to 0.936", but these can vary depending on the barrel size. The gas return path is commonly 0.181" by may be any size as needed. The gas aperture 113 is currently 0.125" but can vary as needed.

In one embodiment, the firearm barrel comprises an aperture which allows a portion of the exhaust gasses to exit the barrel along its length. Whereas most of the exhaust gasses pass through the exit of the barrel, along with the bullet, a portion of the exhaust gasses is allowed to pass through the aperture, or hole in the barrel. In one embodiment the gas block 100 is positioned over the aperture. This allows gases which are released by the aperture to be directed, via the gas block body 101 to the gas return path 106. The gas return path 106, in one embodiment, is fluidly connected to the firearm gas tube. As noted, the firearm gas tube uses and directs the gas to control the self-loading operation.

Figure 4:
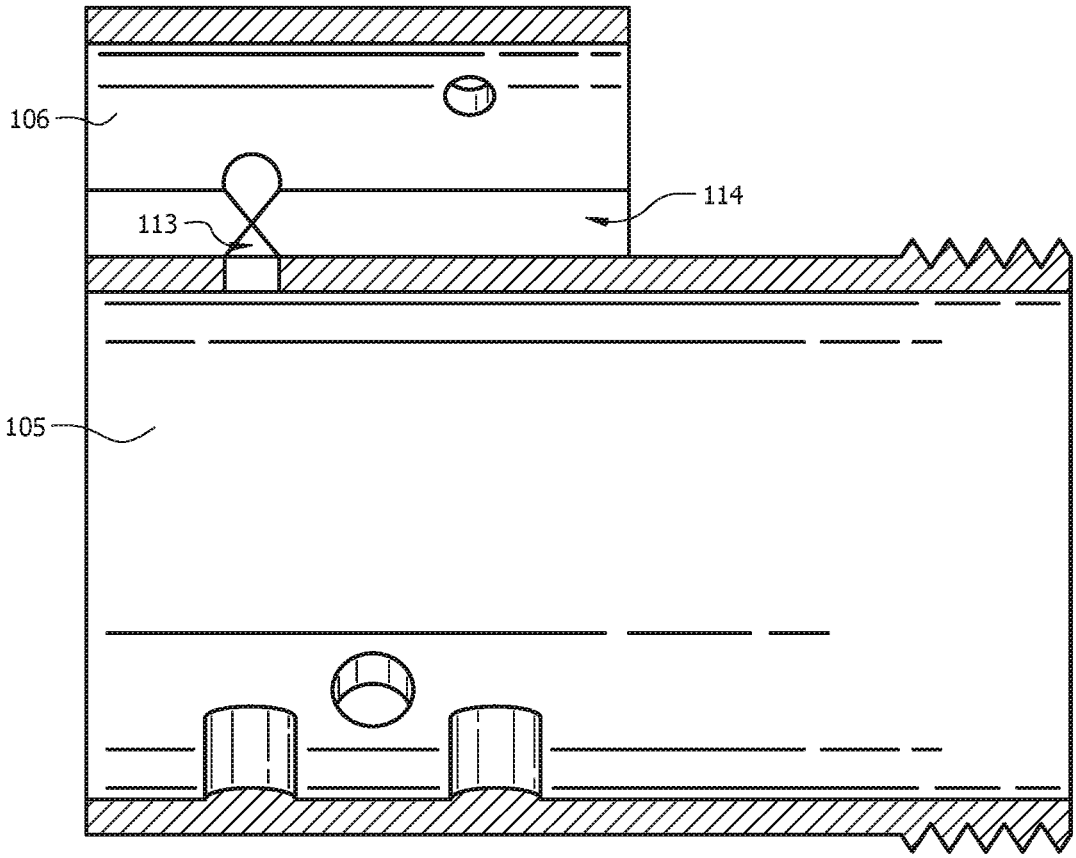
FIG. 4 is a cross-sectional view of the gas block body in one embodiment.

Turning briefly to FIG. 4, FIG. 4 is a cross-sectional view of the gas block body in one embodiment. FIG. 4 shows the main chamber 105 coupled to a gas aperture 113. In one embodiment the aperture in the barrel is aligned with the gas aperture 113.

The gas aperture 113 fluidly connects the main chamber 105 with the plunger channel 114 and the gas return path 106. In one embodiment the gas aperture 113 is approximately perpendicular to both the plunger channel 114 and the gas return path 106. As can be seen, and as will be discussed in more detail below, the plunger channel 114 receives the plunger 107 (as seen in FIG. 2). This restricts the flow of gas through the gas aperture 113 and into the gas return path 106. While a single gas aperture 113 is illustrated, this is for illustrative purposes only and should not be deemed limiting. In other embodiments two or more gas apertures 113 are utilized. Further, while a single aperture 113 is shown coupling the plunger channel 114 and the gas return path 106, in other embodiments they are coupled with a separate and distinct aperture 113.

In one embodiment plunger channel and the main chamber are approximately parallel. In other embodiments, however, they are not parallel.

Returning back to FIG. 2, the gas block body 101 also comprises an elongated coupling member 115 and coupling device 108 which is used to couple to the adjustment knob 104. Any coupling device can be utilized. In one embodiment the coupling device 108 comprises threading. As depicted the external threading on the gas block body 101 is received and engaged by the internal threading 109 of the adjustment knob 104. In other embodiments, however, the coupling device 108 does not comprise threading.

The elongated coupling member 115 is inserted through the wavy spring 102 and the plunger ring assembly 103. Thus, in one embodiment the wavy spring 102 and the plunger ring assembly 103 are held and supported by the elongated coupling member 115. In one embodiment the coupling member 115 is smooth to allow for movement of the wavy spring 102 and the plunger ring assembly 103 along the elongated coupling member 115.

Turning to FIG. 1, as can be seen, the four components, gas block body 101, the wavy spring 102, the plunger ring assembly 103, and the adjustment knob 104 are snugly and tightly coupled. As depicted, the wavy spring 102 is adjacent to and downstream of the gas block body 101. As used herein downstream and upstream refer to relative locations of an item. A downstream item is closer to the exit end of the firearm.

The wavy spring 102 provides pressure between the upstream gas block body 101 and the plunger ring assembly 103. The wavy spring 102 can comprise virtually any material which provides the necessary pressure. In one embodiment the wavy spring 102 is compressible. The materials of the spring will depend, in part, on the duty cycle needed by the end user. Some common materials can include 17-7 stainless steel, A286, or other Inconel alloys. While as described in one embodiment as being wavy, the spring need not be wavy.

As seen in FIG. 3, in one embodiment the wavy spring 103 comprises a plunger indentation 110. The plunger indentation 110 is a notch or indentation located on the wavy spring 103 to provide room for the plunger 107.

Turning to FIG. 2, downstream of the wavy spring 102 is the plunger ring assembly 103. The plunger ring assembly 103 comprises two components: the ring 116 and the plunger 107. The plunger 107 is sized and aligned to be received by the plunger channel 114 (FIG. 4) of the gas block body 101. When the plunger 107 is inserted, it restricts the opening of the gas aperture 113, and accordingly restricts the volume of gas which flows to the gas return path 106. This allows the user to fine tune and control the amount of returned gas.

As depicted, and in one embodiment, the plunger 107 comprises a smooth surface. A smooth surface is a surface which does not have an altered surface texture. One example of an altered surface texture is threading. Accordingly, in one embodiment the plunger 107 does not comprise a threaded surface. A smooth surface is an advantage because it is not susceptible to fouling. Prior art attempts at plunging included a threaded plunger on some portion of the plunger. However, because the threading is in contact with combustion gasses, they are susceptible to fouling. As depicted, and explained in more detail below, the adjustment device described herein is not in contact with the exhaust gasses. Accordingly, the threading on the adjustment knob 104 is not susceptible to fouling. The plunger 107 described herein, has a smooth surface. As such, it can act and function solely as a plunger; it does not also have to function as an adjusting device. It should be noted that only some embodiments have a plunger 107 with a smooth surface. In other embodiments the plunger 107 does not have a smooth surface. As but one example, in one embodiment the plunger 107 comprises a fluted surface or other similar surface.

The plunger 107 is depicted as being cylindrical in shape. This is for illustrative purposes only and should not be deemed limiting. The plunger 107 can comprise any shape which can restrict flow through the gas aperture 113.

In one embodiment, and as depicted, the plunger ring 103 comprises one or more projections 111. As depicted the ring 103 comprises three projections 111. The projections 111 of the plunger ring assembly 103 are sized to engage and be received by detents 112 in the adjustment knob 104. In other embodiments, however, the ring 103 does not comprise projection. Instead, the plunger 107 engages with the detents 112 in the adjustment knob 104.

As depicted, the adjustment knob 104 is downstream of the plunger ring assembly 103. In other embodiments, however, the adjustment knob 104 can be located upstream of the gas block body 101. As noted, in one embodiment the internal threading 109 of the adjustment knob 104 couples with the coupling device 108 of the gas block body 101. As such, the adjustment knob 104 can be tightened or loosened relative to the gas block body 101. Further, the adjustment knob 104 can move upstream and downstream relative to the gas block body 101. As depicted in FIG. 2, if the adjustment knob 104 is tightened, then the adjustment knob 104 urges the upstream plunger ring assembly 103 upstream. Importantly, the plunger 107 is also urged upstream, restricting the flow of gas through the gas aperture 113. Likewise, if the adjustment knob 104 is loosened, then the plunger ring assembly 103 is urged downstream as is the plunger 107. This reduces the restriction and the flow of gas through the gas return path 106 is increased.

While one embodiment has been described wherein the adjustment knob 104 moves upstream and downstream, in other embodiments the adjustment knob 104 is stationary but the plunger 107 moves upstream or downstream upon manipulation of the adjustment knob 104. In one embodiment, for example, the adjustment knob 104 functions similar to lipstick whereby when the adjustment knob 104 is twisted, the lipstick is urged in an outward direction. Thus, in some embodiments the adjustment knob 104 moves upstream or downstream, but in other embodiments the adjustment knob 104 is stationary.

As depicted the adjustment knob 104 comprises one or more gripping elements to facilitate gripping. Because a user can manually grip the adjustment knob 104 and twist, the gripping elements decrease slipping and ensure a tight grip can be obtained. It should be noted that while a knob is illustrated and described, this is for illustrative purposes and should not be deemed limiting. Virtually any device which can advance the plunger 107 relative to the gas plunger channel 114 can be utilized.

As noted, in one embodiment, and as depicted, the adjustment knob comprises one or more detents 112 which couple with the projections 111 of the plunger ring assembly 103. As noted, the wavy spring 102 applies pressure to ensure the plunger ring assembly 103 is pressed against the adjustment knob 104. In so doing, the wavy spring 102 also ensures that the projections 111 are snugly engaged with a corresponding detent 112. When the adjustment knob 104 is rotated, the wavy spring 102 absorbs and sufficiently compresses to allow the projections 111 to be disengaged from the detents 112. However, when the adjustment knob 104 is rotated further, the projections 111 will once again align and engage with a new detent 112. In this fashion, the user can experience tactile feedback as proof that they have achieved the next setting. The user will feel a "click" for each new setting. As stated, the wavy spring 102 can sufficiently compress and expand to allow the projections 111 and the detents 112 to engage and disengage. Once engaged, the wavy spring 102 ensures the projections 111 and detents 112 remain engaged. It should be noted that in one embodiment the spring applies pressure directly to the plunger. In such embodiments, a ring is not necessary.

In one embodiment the adjustment knob 104 comprises a plurality of detents 112 spaced radially along the periphery of the adjustment knob 104. In one embodiment one or more detents is labeled to allow the user visual indicia of the current setting.

While the adjustment knob 104 is being depicted as covering the entire periphery of the barrel, this is for illustrative purposes only and should not be deemed limiting. The adjustment knob 104, as described, moves the plunger 107 to control the flow of gas through the gas return path 106. Thus, any shape, including a shape which does not cover the entire periphery of the barrel, but which allows for the plunger 107 to be advanced as described, can be utilized. A crescent, or other such shape which does not cover the entire periphery of the barrel can also be utilized. As another example, the adjustment knob 104 can comprise a lever which extends radially away from the barrel. The user can apply a torque on the lever to advance the plunger 107 in the desired direction. The lever can be coupled, as a single piece, to the adjustment knob 104. As an example, in this embodiment the adjustment knob 104 would comprise a ring with at least one extending lever. In other embodiments, the lever can be added as an accessory which couples to the adjustment knob 104.

The user may need to adjust the gas block as described depending upon a variety of parameters. As but one example, when using varying ammunition, the gas block may need to be adjusted to ensure correct operation of the self-loading function. Additionally, firearm accessories such as a choke, suppressor, flash-hider, etc. may alter the volume of exhaust gas. As such, the user may need to adjust the gas block to increase or decrease the volume of returned gas. The gas block described herein allows the user to easily and quickly make the necessary adjustments. In one embodiment the knob 104 comprises numbers to allow the user to quickly make the necessary adjustments.

Figure 5:
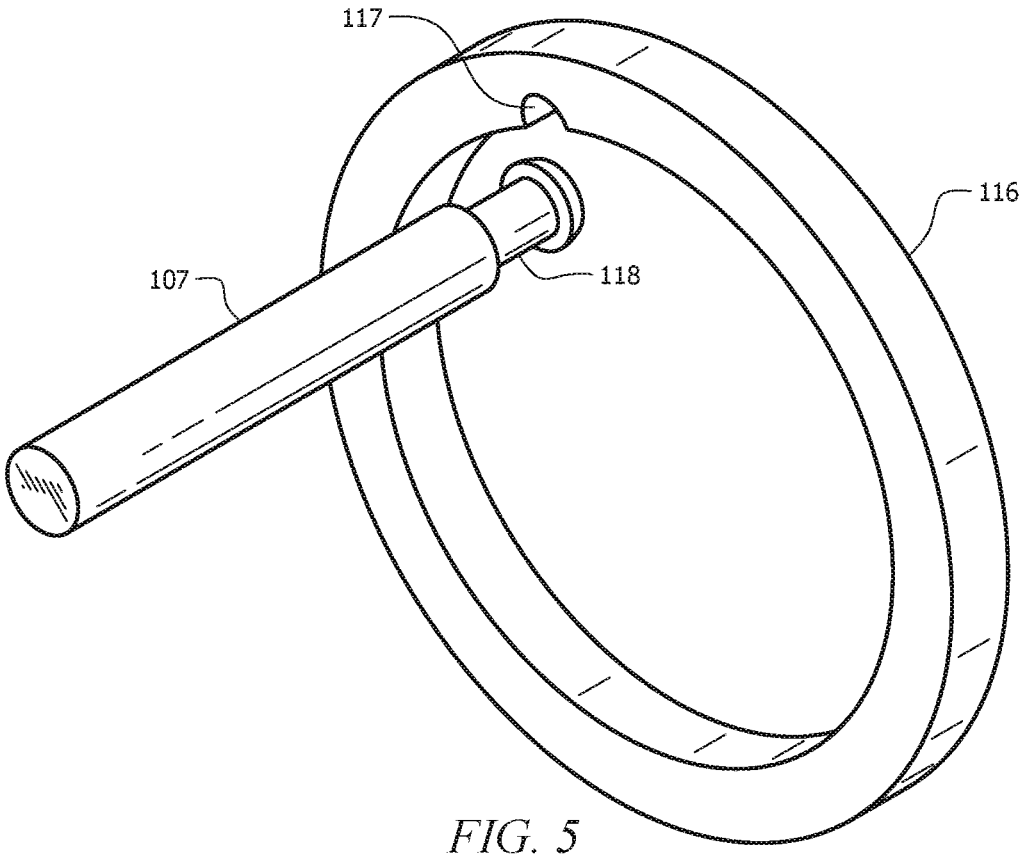
FIG. 5 is a perspective of a plunger in one embodiment.

In one embodiment, and as depicted, the plunger ring assembly 103 comprises two components, the ring 116 and the plunger 107, coupled as a single item. In one embodiment the ring assembly 103 is a single integrally made piece, meaning the plunger 107 and the ring assembly 103 are a single, permanently coupled, piece. In other embodiments, however, the ring 116 and the plunger 107 are two separate and distinct components which can be coupled and decoupled. FIG. 5 shows a distinct plunger 107 and a separate ring 116. As shown the ring 116 comprises a coupling void 117. The coupling void 117 mates and couples with a groove 118 located on the downstream end of the plunger 107. In this fashion, the plunger 107 can be installed and removed from ring 116. While a coupling void 117 and notch 118 are shown, this is for illustrative purposes only and should not be deemed limiting. Virtually any method of releasably coupling two parts together can be utilized.

Having a separate plunger 107 and ring 116 allows various sized plungers 107 to be used with the ring 116. As an example, if a larger gas return path 106 is needed, rather than having to replace the entire plunger ring assembly 103, the user can simply decouple the previous plunger 107 and thereafter coupler a shorter plunger 107. The plunger and plunger ring being modular allows a different plunger 107 to be swapped for different sizes to account for different performance variables. This adds to the flexibility and versatility of the system.

Figure 6:
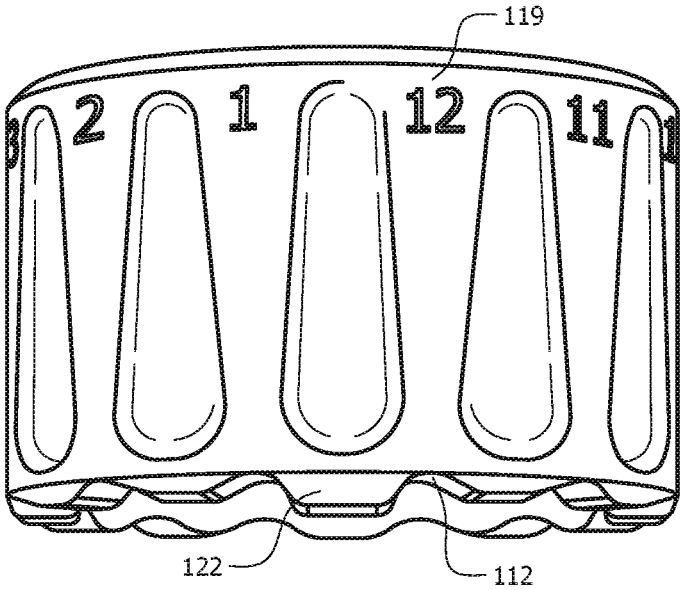
FIG. 6 is a perspective view of a rotation stop in one embodiment.

FIG. 6 is a perspective view of a rotation stop in one embodiment. As shown the adjustment knob 104 comprises identification 119 which shows the user the current setting. The user can rotate the adjustment knob 104 and receive visual indication of the setting in numbers 1-12, as depicted. In one embodiment the knob 104 has several detents 112 located along the lower periphery. The different detents 112 correspond to a setting. As noted, the user can rotate the knob 104 for different settings. However, since setting 1 and setting 12, in this embodiment, are adjacent to one another, without any restriction the user could move from 1 to 12.

Accordingly, in one embodiment the knob 104 comprises a stop 122. The stop 122 prevents the knob 104 from rotating beyond the stop 122. The stop 122 is a physical protrusion which prevents the knob 104 from further rotation. This helps ensure the user must incrementally increase or decrease the setting as opposed to a cliff-effect moving from 1 to 12. The stop 122 also provides tactical confirmation of when the user has reached a specific setting. The user can realize this without visually witnessing the stop.

The stop 122 can comprise a physical raised protrusion which prevents further engagement. In another embodiment the stop 122 can comprise a recess or other feature which creates a stop. In other embodiments the stop 122 comprises an external restriction which prevents rotation of the knob.

Figure 7:
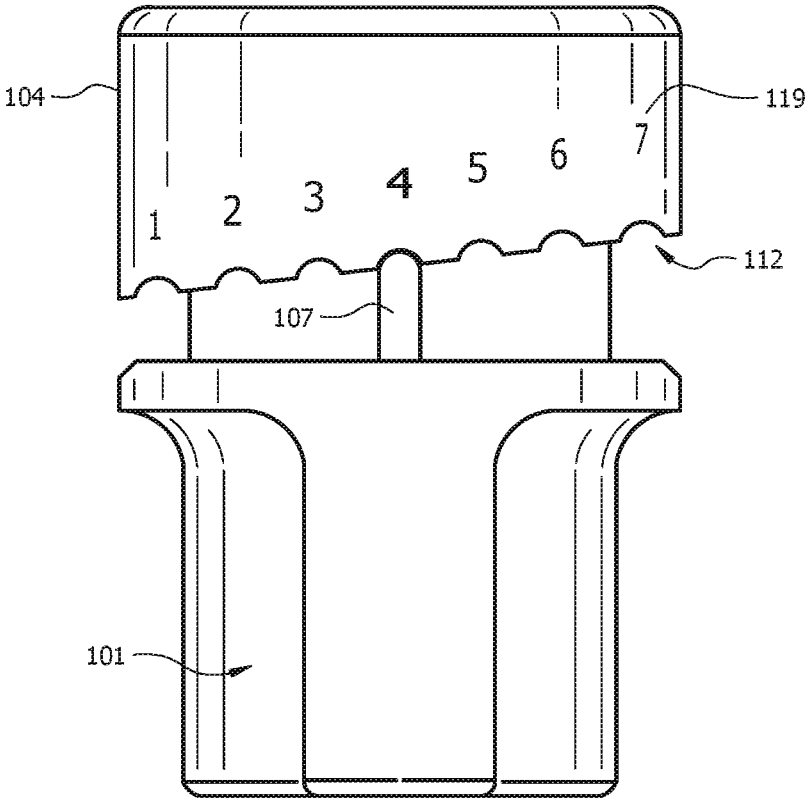
FIG. 7 is a view of a knob with angled detents in one embodiment.

FIG. 7 is a view of a knob with angled detents in one embodiment. As can be seen, the elevation of each detent 112 differs such that they are angled relative to one another. In such an embodiment, instead of pushing the plunger, the knob 104 has an offset camming surface that pushes/releases the plunger 107 in/out of the body. As can be seen, identification 7, as an example, is raised relative to identification 1. The relative location of the plunger 107 moves relatively in or out depending upon the elevation of the selected identification. This embodiment can likewise use a stop 122 as previously described.

In one embodiment the plunger is biased in or out with a biasing device, as described below. In such embodiments, for example, the plunger 107 can be biased upward (as shown in FIG. 7). Thus, when the knob 104 is rotated to allow the plunger 107 to reach elevated detents 112, the plunger 107 will automatically bias upwards.

Figure 8:
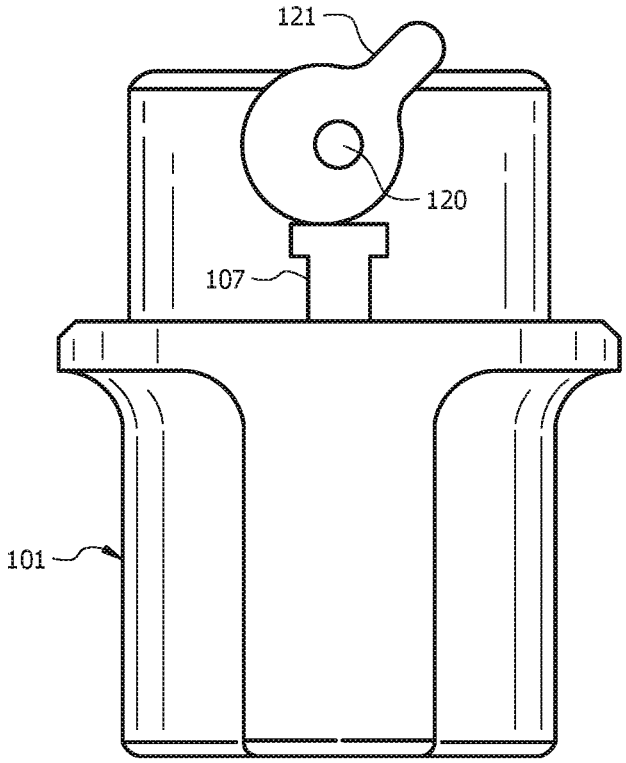
FIG. 8 is a top view of an embodiment utilizing a cam lever.
Figure 9A:
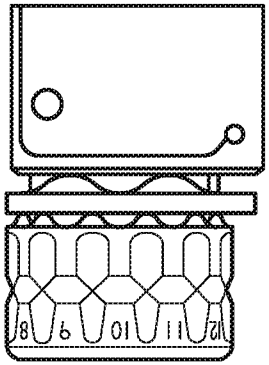
FIGS. 9A-D illustrate various knob lengths.
Figure 9B:
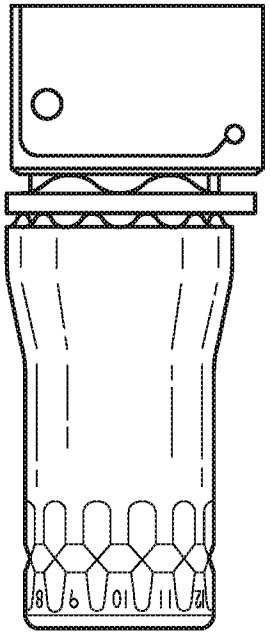
Figure 9C:
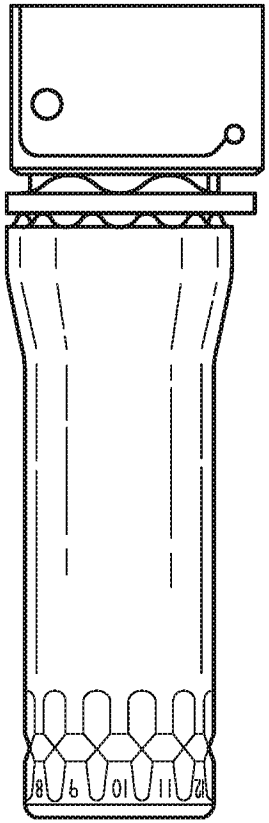
Figure 9D:
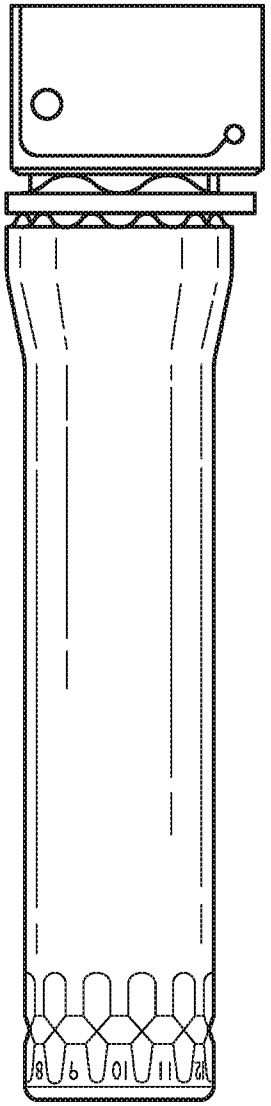

FIG. 8 is a top view of an embodiment utilizing a cam lever. In this embodiment the position of the plunger 107 is controlled by a cam lever 121 and a pivot pin. Adjusting the cam lever 121 pushes or releases the biased plunger 107 in or out of the body with a camming path. In one embodiment the path is an elliptical camming path. The biasing can be any method or device known in the art. In one non-limiting example, the biasing results from a spring.

In one embodiment, and as depicted, there is an offset position of the cam lever 121 relative to the pivot pin 120. While the cam lever 121 and the pivot pin 120 are attached to a cylindrical protrusion forward of the body, in other embodiments a cantilevered extension forward of the top of the body can also be utilized.

FIG. 8 illustrates other mechanism which can be used to control the location and placement of the plunger 107. This specific example is for illustrative purposes only and should not be deemed limiting.

FIGS. 9A-D illustrate various knob lengths. The assembly can vary depending upon the desired application.

The gas block 100 described herein provides many advantages compared to prior art gas blocks. The first advantage is the ability to fine-tune the adjustment. Many prior art gas blocks simply offered an "all or none" approach. Thus, either the gas block returned exhaust gas or it did not. The gas block described herein allows fine tuning and tweaking of the control. As but one example, consider if a first setting allowed insufficient gas return. Perhaps there was insufficient returned gas to allow for proper self-loading. The user would then twist the adjustment knob 104 in a counterclockwise function. The projections 111 of the plunger ring assembly 103 would be temporarily disengaged from the detents 112 in the adjustment knob 104. When the adjustment knob 104 was rotated such that a new detent 112, or set of detents 112, became properly aligned with the projections 111 of the stationary plunger ring 103, then the user had achieved a second setting. The plunger 107 would be urged upstream within the plunger channel 114 to partially restrict the gas aperture 113. The user can repeat the process for third, fourth, etc. settings with the plunger 107 increasingly restricting the gas aperture 113. The user can find and utilize a precise setting which allows for the desired amount of return gas.

Second, the adjustment, in one embodiment, does not require any outside tools. Prior art adjustable gas blocks required tools, and often specialized tools, to adjust the gas block. The user had to obtain and carry the tools when they desired to adjust the gas block. Such a scenario is undesirable as this is an additional item that the user must carry. Thus, in one embodiment discussed herein, the user simply uses their hand to grasp the adjustment knob 104 and twist. The user does not require any special tools or equipment.

Third, the adjustment mechanism, in one embodiment, is located circumferentially around the firearm's barrel. Often the adjustment device is placed above or below the barrel. Often such a position is difficult to obtain or manipulate. This issue is compounded if a tool must be coupled, in an awkward position, to manipulate or adjust the adjustment mechanism. Because the adjustment mechanism is located circumferentially around the barrel, it can be adjusted at any accessible angle. The adjustment knob 104 can be gripped from the top, bottom, or sides. Thus, because the adjustment knob 104 is located around the barrel, accessing the adjustment knob 104 to make adjustments is increased.

Fourth, as noted, the adjustment mechanism, in this case the adjustment knob 104, has no direct contact to the exhaust gasses. Because these exhaust gasses are combustion gasses, they can leave a carbon residue. This residue results in fouling and plugging. If the adjustment mechanism were exposed to the exhaust gasses, as in prior art gas blocks, it has a tendency to foul and plug. However, by maintaining the adjustment knob 104 free of contact with the exhaust gasses, this fouling and plugging of the adjustment knob 104 due to exhaust gasses is eliminated. The result is a more reliable product which exhibits reduced downtime due to maintenance.

As noted, prior art attempts use the same component as both a gas flow reducer and the adjustment mechanism. As described herein, in one embodiment, the gas flow reducer, the plunger, and the adjustment mechanism, the adjustment knob 104, are two separate components. This is what allows the plunger 107 to be in contact with the exhaust gasses while preventing the adjustment knob 104 from being in contact with the exhaust gasses.

A fifth benefit is the ability to easily and quickly assemble and disassemble the gas block. As can be seen, in one embodiment the gas block comprises four or five components which can easily be assembled or disassembled for maintenance. This is contrasted with prior art attempts which required multiple screws, springs, etc. Here the wavy spring 102 simply slides over the gas block body 101, as does the plunger ring 103, and the adjustment knob 104 is coupled to the gas body block 101. Assembly and disassembly is very simple and does not require any fine parts or separate tools.

While the invention has been particularly shown and described with reference to a preferred embodiment, it will be understood by those skilled in the art that various changes in form and detail may be made therein without departing from the spirit and scope of the invention.

ADDITIONAL DISCLOSURE

The following clauses are offered as further description of the disclosed invention.

Clause 1. A system for an adjustable gas block, said system comprising:

a gas block body comprising a main chamber fluidly coupled to a gas aperture, wherein said gas aperture is fluidly connected with a gas return path and a plunger channel;

a plunger assembly downstream from said gas block body, wherein said plunger assembly comprises a ring and a plunger;

an adjustment knob located downstream from said plunger assembly;

wherein said adjustment knob couples to said gas block body, and wherein when said adjustment knob is manipulated, said plunger is urged upstream and downstream to said gas block body.

Clause 2. The system of any proceeding or preceding claim wherein said plunger extends upstream from said ring.

Clause 3. The system of any proceeding or preceding claim wherein said plunger is releasably coupled to said ring.

Clause 4. The system of any proceeding or preceding claim wherein said gas block body comprises an elongated coupling member and a coupling device, and wherein said adjustment knob couples with said coupling device.

Clause 5. The system of any proceeding or preceding claim wherein said plunger assembly rests on said elongated coupling member.

Clause 6. The system of any proceeding or preceding claim further comprising a wavy spring downstream from said gas block body and upstream from said plunger assembly.

Clause 7. The system of any proceeding or preceding claim wherein said plunger assembly comprises at least one projection, and wherein said adjustment knob comprises at least two detents, and wherein said detents receive said at least one projection.

Clause 8. The system of any proceeding or preceding claim wherein at least a portion of plunger extends in the plunger channel.

Clause 9. The system of any proceeding or preceding claim wherein said plunger comprises a smooth surface.

Clause 10. The system of any proceeding or preceding claim wherein the amount of plunger received in said gas return path is adjusted with said adjustment knob.

Clause 11. The system of any proceeding or preceding claim wherein gas block body, said ring, and said adjustment knob each comprise a central and aligned void.

Clause 12. The system of any proceeding or preceding claim wherein said gas return path, said plunger channel, and said main chamber are approximately parallel, and wherein said gas return path is located atop said plunger channel, and wherein said plunger channel is located atop said main chamber.

Clause 13. The system of any proceeding or preceding claim further comprising a firearm with a barrel, wherein said barrel is inserted through said central chamber and extends through the ring of the plunger assembly and through the adjustment knob.

Clause 14. The system of any proceeding or preceding claim wherein gas block surrounds the outer periphery of said barrel.

Clause 15. The system of any proceeding or preceding claim wherein said firearm comprises a firearm gas tube, and wherein said gas return path is fluidly coupled to said firearm gas tube.

Clause 16. The system of any proceeding or preceding claim wherein no tools are necessary to move said plunger upstream or downstream relative to the gas body block.

Clause 17. The system of any proceeding or preceding claim wherein said adjustment knob has no direct contact with exhaust gasses.

Clause 18. The system of any proceeding or preceding claim wherein said adjustment knob advances upstream and downstream.

Clause 19. The system of proceeding or preceding claim wherein said adjustment knob does not advance upstream or downstream.

What is claimed is:

1. A system for an adjustable gas block, said system comprising:

a gas block body comprising a main chamber fluidly coupled to a gas aperture, wherein said gas aperture is fluidly connected with a gas return path and a plunger channel;

a plunger assembly downstream from said gas block body;

an adjustment knob;

wherein said adjustment knob couples to said gas block body, and wherein when said adjustment knob is manipulated, said plunger is urged upstream and downstream relative to said gas block body wherein said plunger assembly comprises at least one projection, and wherein said adjustment knob comprises at least two detents, and wherein said detents receive said at least one projection.

2. The system of claim 1 wherein said gas block body comprises an elongated coupling member and a coupling device, and wherein said adjustment knob couples with said coupling device.

3. The system of claim 1 wherein said plunger comprises a smooth surface.

4. A system for an adjustable gas block, said system comprising:

a gas block body comprising a main chamber fluidly coupled to a gas aperture, wherein said gas aperture is fluidly connected with a gas return path and a plunger channel;

a plunger assembly downstream from said gas block body;

an adjustment knob;

wherein said adjustment knob couples to said gas block body, and wherein when said adjustment knob is manipulated, said plunger is urged upstream and downstream relative to said gas block body wherein said gas return path, said plunger channel, and said main chamber are approximately parallel, and wherein said gas return path is located atop said plunger channel, and wherein said plunger channel is located atop said main chamber.

5. A system for an adjustable gas block, said system comprising:

a gas block body comprising a main chamber fluidly coupled to a gas aperture, wherein said gas aperture is fluidly connected with a gas return path and a plunger channel;

a plunger assembly downstream from said gas block body;

an adjustment knob;

wherein said adjustment knob couples to said gas block body, and wherein when said adjustment knob is manipulated, said plunger is urged upstream and downstream relative to said gas block body; the system further comprising a firearm with a barrel, wherein said barrel is inserted through said central chamber and extends through the ring of the plunger assembly and through the adjustment knob.

6. The system of claim 1 wherein said at least two detents are angled.

7. A system for an adjustable gas block, said system comprising:

a gas block body comprising a main chamber fluidly coupled to a gas aperture, wherein said gas aperture is fluidly connected with a gas return path and a plunger channel;

a plunger assembly downstream from said gas block body, wherein said plunger is coupled to a cam lever, and wherein said cam lever controls movement of said plunger, and wherein said plunger is urged upstream and downstream relative to said gas block body.

8. The system of claim 7 further comprising a pivot pin.

9. The system of claim 8 wherein pivot pin and said cam lever are offset.

10. The system of claim 7 wherein no tools are necessary to move said plunger upstream or downstream relative to the gas body block.

11. The system of claim 7 wherein said cam lever does not advance upstream or downstream.

12. The system of claim 11 wherein said cam lever comprises at least one identification.

* * * * *